US008028879B2

(12) United States Patent
Amishay

(10) Patent No.: US 8,028,879 B2
(45) Date of Patent: Oct. 4, 2011

(54) MULTI USE BAG

(76) Inventor: Yair Amishay, Tel Aviv (IL)

( * ) Notice: Subject to any disclaimer, the term of this patent is extended or adjusted under 35 U.S.C. 154(b) by 265 days.

(21) Appl. No.: 11/792,957

(22) PCT Filed: Dec. 4, 2005

(86) PCT No.: PCT/IL2005/001300

§ 371 (c)(1),
(2), (4) Date: Jun. 13, 2007

(87) PCT Pub. No.: WO2006/064492

PCT Pub. Date: Jun. 22, 2006

(65) Prior Publication Data

US 2008/0169325 A1 Jul. 17, 2008

(30) Foreign Application Priority Data

Dec. 16, 2004 (IL) ..... 165825

(51) Int. Cl.
*A45F 3/02* (2006.01)
*A45F 3/04* (2006.01)

(52) U.S. Cl. ..... 224/578; 224/579

(58) Field of Classification Search ..... 224/578, 224/579

See application file for complete search history.

(56) References Cited

U.S. PATENT DOCUMENTS

| | | | | |
|---|---|---|---|---|
| 4,687,036 | A * | 8/1987 | Thomas | 150/118 |
| 4,763,763 | A | 8/1988 | Sadow | |
| 4,810,102 | A | 3/1989 | Norton | |
| 5,119,910 | A | 6/1992 | Heggeland | |
| 5,415,332 | A | 5/1995 | Kliot | |
| 5,577,652 | A | 11/1996 | Cooper | |
| 5,730,347 | A | 3/1998 | Finot | |
| D402,107 | S | 12/1998 | Allison | |
| 5,887,770 | A * | 3/1999 | Covell | 224/153 |
| D410,329 | S | 6/1999 | Wyatt et al. | |
| 5,927,581 | A | 7/1999 | Reddy et al. | |
| 6,024,265 | A | 2/2000 | Clements | |
| 6,138,881 | A | 10/2000 | Paul et al. | |
| 6,220,493 | B1 | 4/2001 | Ljima et al. | |
| 6,390,345 | B1 | 5/2002 | Brown et al. | |

FOREIGN PATENT DOCUMENTS

| | | |
|---|---|---|
| JP | 08-154721 | 6/1996 |
| WO | WO 2004/002266 | 1/2004 |

OTHER PUBLICATIONS

Chinese Office Action of Application No. 200580043595.8 mailed on Oct. 9, 2009.

International Search Report of Application No. PCT/IL05/01300 mailed on Jun. 20, 2006.

* cited by examiner

*Primary Examiner* — Justin Larson

(74) *Attorney, Agent, or Firm* — Pearl Cohen Zedek Latzer, LLP

(57) ABSTRACT

The present invention relates and provides a versatile multi use bag which can be configured to serve as a shoulder-side or frontal suspended carrying bag, or as a neck suspended carrying bag or as a rucksack. The bag being a multi-compartment carrying bag and rucksack, comprising a multi-compartment openable body to contain whatever items are to be transported by the user, an extended-length strap with means at both ends thereof whereby the strap can be releasably anchored to the body of the bag. A tunnel-like portion attached proximate to an edge of the body wherethrough the strap can be inserted; and at least two spaced-apart anchor points positioned proximate to the outer perimeter of the body whereto the strap ends may be releasably attached.

8 Claims, 2 Drawing Sheets

MULTI USE BAG

CROSS-REFERENCE TO RELATED APPLICATIONS

This application is a National Phase Application of PCT International Application No. PCT/IL2005/001300, International Filing Date Dec. 4, 2005, entitled "Multi Use Bag", published on Jun. 22, 2006 as International Publication Number WO 2006/064492, claiming priority of Israeli Patent Application, IL 165825, filed Dec. 16, 2004.

FIELD OF AND BACKGROUND OF THE INVENTION

The present invention relates to personal luggage.

More particularly, the invention provides a versatile multi use bag which can be configured to serve as a shoulder-side or frontal suspended carrying bag, or as a neck suspended carrying bag or as a rucksack.

As is known, rucksacks have been used for hundreds of years, and are still being manufactured and carrying the personal belongings of travelers today. Among improvements in modern designs can be mentioned features such as the use of lightweight synthetic waterproof materials, durable non-rusting zippers for closing pockets and rigid frameworks to ensure that the rucksack sits correctly on the back of the user. Examples of modern designs and proposed improvements can be seen in U.S. Pat. No. 5,730,347 to Finot, U.S. Pat. No. 6,024,265 to Clements and U.S. Pat. No. Des. 402,107 to Allison. In U.S. Design Pat. No. 410,329 Wyatt et al. disclose a rucksack combined with a net bag.

None of the known disclosures claim a convertible bag-rucksack. Such an item is however useful as there are situations when a bag is preferable, for example when the user is sitting in a vehicle or just casual use. There are other situations when the rucksack is preferable, such as when hiking long distances or bicycling, or when some activity requires free use of both arms.

OBJECTS OF THE INVENTION

It is therefore one of the objects of the present invention to obviate the limitations of prior art luggage items and to provide a convertible multi use item which can be used either as a rucksack or as a strap-suspended shoulder bag.

It is a further object of the present invention to provide such convertible multi use item using only a single strap.

Yet a further aim of the present invention is to provide a bag which when suspended on the front part of the body of a user has readily accessible pocket compartments.

SUMMARY OF THE INVENTION

The present invention achieves the above objects by providing a multi-compartment carrying bag and rucksack, comprising

- a multi-compartment openable body to contain whatever items are to be transported by the user,
- an extended-length strap provided with means at both ends thereof whereby said strap can be releasably anchored to said body;
- a tunnel-like portion attached proximate to an edge of said body wherethrough said strap can be inserted; and
- at least two spaced-apart anchor points positioned proximate to the outer perimeter of said body whereto said strap ends may be releasably attached.

In a preferred embodiment of the present invention there is provided a carrying bag and rucksack wherein said tunnel-like portion is disposed proximate to an edge of said body opposite the edge at which said spaced-apart anchor points are disposed.

In a most preferred embodiment of the present invention there is provided a carrying bag and rucksack wherein said strap is sufficiently long to be attached at a first end to a first of said anchor points, to form a first loop for shoulder suspension, and to extend through said tunnel-like portion, and to form a second loop for shoulder suspension and to be attached at a second end to a second of said anchor points.

Yet further embodiments of the invention will be described hereinafter.

It will thus be realized that the novel luggage item of the present invention can be fast changed over for use as either as a shoulder bag or as a rucksack or frontal suspended. In either case the same single strap is used. The single strap, which is not sewn onto the body of the bag/rucksack provides a cost advantage for the manufacturer thereof. This benefit may be small but in the highly competitive luggage market the saved cost is a definite advantage.

It should be noted that when the bag is used as a shoulder bag, there are two carrying options, as the head of the user can be either external or internal to the large carrying loop.

The bag illustrated is intended and suitable for either option.

SHORT DESCRIPTION OF THE DRAWINGS

The invention will now be described further with reference to the accompanying drawings, which represent by example preferred embodiments of the invention. Structural details are shown only as far as necessary for a fundamental understanding thereof. The described examples, together with the drawings, will make apparent to those skilled in the art how further forms of the invention may be realized.

FULL DESCRIPTION OF THE INVENTION

Figure 1:
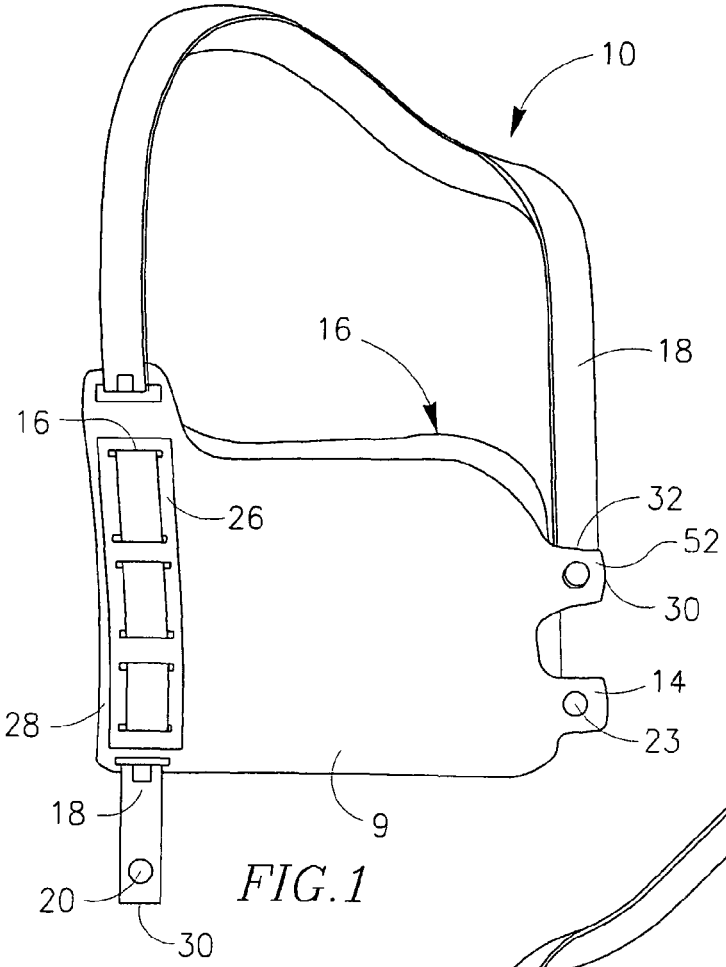
FIG. 1 is a perspective rear view of a preferred embodiment of the bag according to the invention.

There is seen in FIG. 1 the rear face 9 of a two-compartment carrying bag 10. The compartments 12, 14 (seen in FIG. 2) are of a size to contain whatever items are to be transported by the user. Together the compartments 12, 14 form the body 16 of the bag 10.

An extended-length strap 18 is provided. At both ends thereof means 20 are provided to allow releasable anchoring thereof to the body 16 of the bag 10. For this purpose two anchoring points 22, 24 are provided which are seen at the right edge of the figure. The anchoring points could be moved to different location on the bag. A tunnel-like portion 26 is attached proximate to an edge 28 of the bag body 16, wherethrough the strap 18 is inserted.

Thus the tunnel-like portion 26 is disposed opposite the edge 30 at which the spaced-apart anchor points 22, 24 are disposed. In the shown embodiment the strap 18 is weaved in and out of the tunnel-like portion 26, which results in an arrangement wherein the strap 18 tends to stay in the position in which it was inserted, due to friction, while leaving free the strap end 38 even without being anchored. Thus when the bag 10 is only lightly loaded it is not essential to attach the second end 38 of the strap 18 to the free anchor point 24 because frictional effects between the strap 18 and the tunnel-like portion 26 are sufficient to prevent the strap 18 sliding therethrough. At any rate it would be possible to anchore the end by means 20 to an anchoring point.

The first strap end 32 is seen releasably attached to a first of two spaced-apart anchor points 22, 24 positioned proximate to the outer perimeter of the body 16.

Figure 5:
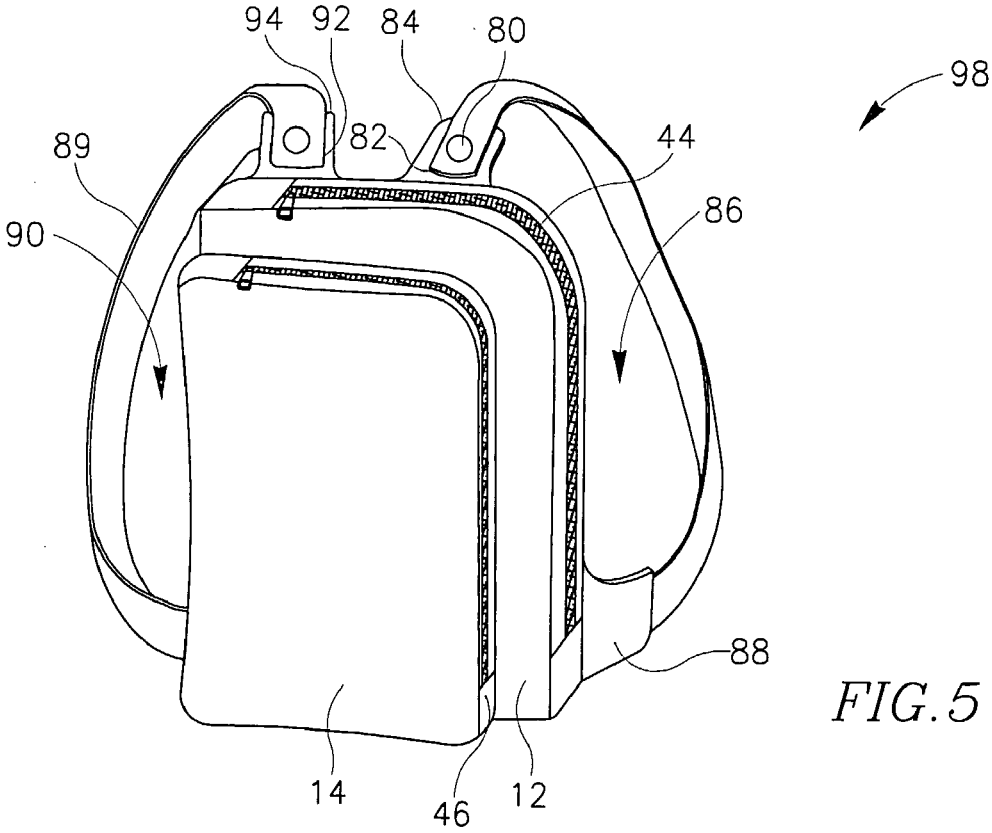
FIG. 5 is a perspective view of a preferred of the bag set up as a rucksack.

When the strap 18 is further pulled through the tunnel-like portion 26 the second end 38 may be attached to the second anchor point 36 as will be seen in FIG. 5

With reference to the rest of the figures, similar reference numerals have been used to identify similar parts.

Figure 2:
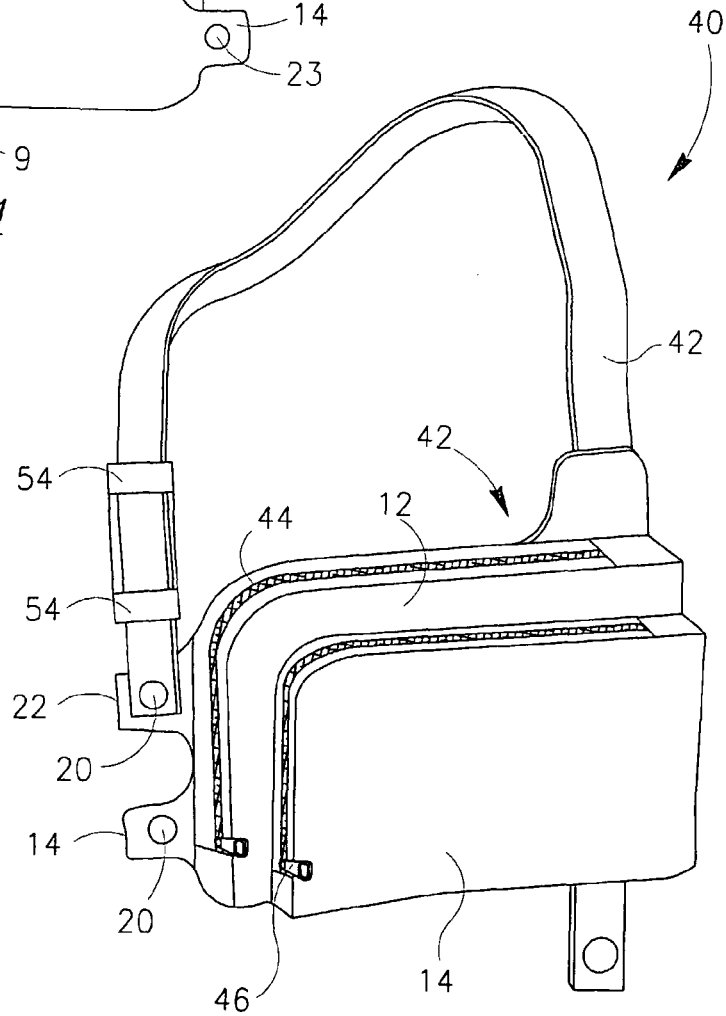
FIG. 2 is a perspective front view of an embodiment provided with an adjustable length strap.

Referring now to FIG. 2, there is seen an embodiment of the carrying bag/rucksack 40 wherein the multi-compartment openable body 42 is provided with openings closable by zippers 44, 46. The zipper 46 and the bag openings are readily accessible to the user when the body 42 is suspended from a shoulder of the user by the strap 48, the head of the user being inside the diagonal strap loop and the bag 40 being carried adjacent to the front of the user.

The strap 52 is length adjustable by prior-art means such as buckles 54. The provision of strap length adjustment means is advantageous, as the various optional carrying modes (shoulder with/without head, and rucksack) and the varying size of users may require different strap lengths.

Figure 3:
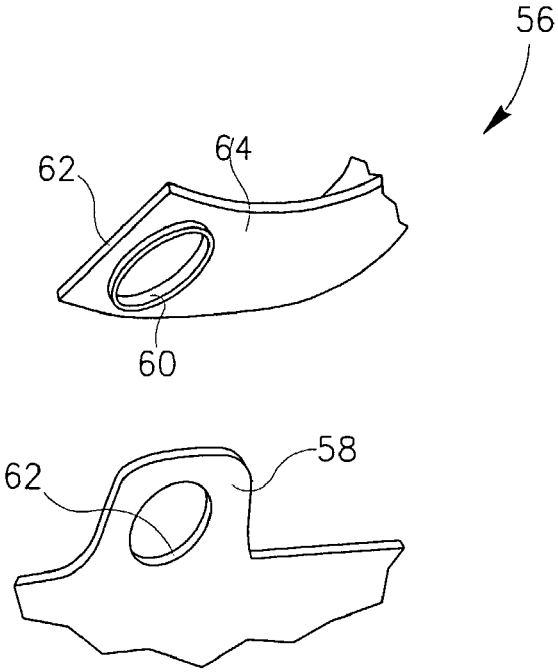
FIG. 3 is a detail view of a preferred strap-attachment configuration.

Seen in FIG. 3 is a detail of an embodiment of the carrying bag/rucksack 56 wherein the strap end 52 is releasably attached to the anchor point 58 by means of a circular press stud 60, 62. The press stud 60, 62 shown in the figure is about 15-20 mm diameter. Thus the connected strap 64 will have a disengagement resistance of about 40-60 Newton.

The male portion of the press stud 60 is received by a circular female component 62 allowing the strap 64 to revolve relative to the anchor point 58 to which it is attached. Thus the strap 64 will adjust itself to its optimum orientation immediately the bag/rucksack 56 is put into use as it must pivote about 90°.

Figure 4:
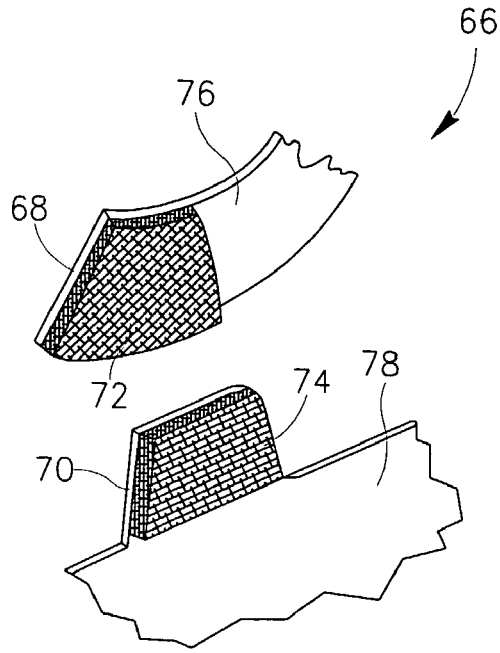
FIG. 4 is a detail view of a further preferred strap-attachment configuration.

Referring now to FIG. 4, there is depicted an embodiment of the bag/rucksack 66 wherein the strap ends 68 can be releasably attached to the anchor points 70 by means of hook and loop fasteners 72, 74 such as "VELCRO"™ brand hook and loop pads or fasteners. The advantage of the hook-and loop fasteners is that they are more easily opened when required. However in order to obtain best results the orientation of the strap 76 relative to the bag 78 when in use needs to be known at the time of attachment.

FIG. 5 shows an embodiment of the bag/rucksack 96 wherein the strap 80 is sufficiently long to be attached at a first end 82 to a first of the anchor points 84 to form a first loop 86 for shoulder suspension, and to extend through the tunnel-like portion 88, and then to form a second loop 90 for shoulder suspension and to be attached at a second end 92 to a second of the anchor points 94. The result is as seen in the figure is that the carrying bag is arranged as a rucksack.

The scope of the described invention is intended to include all embodiments coming within the meaning of the following claims.

In particular it will be realized that the strap ends can alternatively be attached to the body of the bag/rucksack using conventional metal or plastic buckles, the anchoring points could be on different locations depending on the model of bag. Likewise the bag could be of any configuration and shape and the manner of carrying could vary.

The foregoing examples illustrate useful forms of the invention, but are not to be considered as limiting its scope, as those skilled in the art will be aware that additional variants and modifications of the invention can readily be formulated without departing from the meaning of the following claims.

I claim:

1. A multi-compartment carrying bag and rucksack, comprising:

a multi-compartment openable body, a strap; anchoring means at both ends of said strap whereby said strap can be releasably anchored to said body;

a tunnel-like portion extending from a first edge of said body to a second edge of said body along a third edge of said body, orthogonal to said first edge and said second edge, wherein the length of said tunnel-like portion substantially equals the length of said third edge;

wherein said strap is weaved in and out of said tunnel-like portion in both said carrying bag and said rucksack carrying modes to result in an arrangement wherein said strap tends to stay in its position due to friction between the strap and the tunnel-like portion; and at least two spaced-apart anchor points positioned proximate to the outer perimeter of said body whereto said strap ends may be releasably attached;

wherein both ends of said strap are anchored each to a respective one of said spaced-apart anchor points when carried in rucksack carrying mode, and only one end of said strap is anchored to any one of said spaced-apart anchor points and said other end of said strap is not anchored to any one of said spaced-apart anchor points to leave said other end of said strap free when carried in carrying bag mode.

2. The carrying bag and rucksack as claimed in claim 1, wherein said multi-compartment openable body is provided with zip openings readily accessible to the user when said body is suspended from a shoulder of the user by said strap and is carried adjacent to the front of said user.

3. The carrying bag and rucksack as claimed in claim 1, wherein said strap is length adjustable.

4. The carrying bag and rucksack as claimed in claim 1, wherein said tunnel-like portion is disposed proximate to an edge of said body opposite to an edge at which said spaced-apart anchor points are disposed.

5. The carrying bag and rucksack as claimed in claim 1, wherein said strap ends are releasably attached to said anchor points by means of circular press studs allowing said strap to revolve relative to the anchor point to which it is attached.

6. The carrying bag and rucksack as claimed in claim 1, wherein said strap ends are releasably attached to said anchor points by means of hook and loop fasteners.

7. The carrying bag and rucksack as claimed in claim 1, wherein said strap is sufficiently long to be attached at a first end to a first of said anchor points, to form a first loop for shoulder suspension, and to extend through said tunnel-like portion, and to form a second loop for shoulder suspension and to be attached at a second end to a second of said anchor points.

8. The carrying bag and rucksack as claimed in claim 1, wherein said tunnel-like portion is characterized by at least four parallel through holes.

* * * * *